US005385253A

United States Patent [19]

Scharf et al.

[11] Patent Number: 5,385,253

[45] Date of Patent: Jan. 31, 1995

[54] PORT CLOSURE

[75] Inventors: Michael W. Scharf; Joseph N. Veillon, Jr., both of McHenry, Ill.; Thomas Yatsko, Royersford, Pa.

[73] Assignee: Baxter International Inc., Deerfield, Ill.

[21] Appl. No.: 939,348

[22] Filed: Sep. 2, 1992

[51] Int. Cl.[6] ..... B65D 39/00

[52] U.S. Cl. ..... 215/296; 215/305; 215/354; 215/355; 215/DIG. 3

[58] Field of Search ..... 215/232, 247, 296, 305, 215/354, 355, DIG. 3

[56] References Cited

U.S. PATENT DOCUMENTS

| | | | |
|---|---|---|---|
| D. 273,227 | 3/1984 | Wilkinson . | |
| 1,127,357 | 2/1915 | Gavaza . | |
| 1,902,892 | 3/1933 | Pottenger, Jr. et al. . | |
| 1,946,981 | 2/1934 | Lower . | |
| 2,111,731 | 3/1938 | Reach . | |
| 2,215,392 | 9/1940 | Freeman . | |
| 2,372,182 | 3/1945 | Barr . | |
| 2,704,100 | 3/1955 | Freeman . | |
| 3,540,612 | 11/1970 | Brady | 215/354 X |
| 3,750,820 | 8/1973 | Labarre . | |
| 3,851,783 | 12/1974 | Braginetz | 215/232 |
| 4,008,820 | 2/1977 | Ruetz | 215/256 |
| 4,094,429 | 6/1978 | Urbin | 215/305 |
| 4,133,441 | 1/1979 | Mittleman et al. . | |
| 4,187,893 | 2/1980 | Bujan . | |
| 4,244,480 | 1/1981 | Puig Planas . | |
| 4,279,352 | 7/1981 | Ward . | |
| 4,297,316 | 10/1981 | Cunningham . | |
| 4,301,590 | 11/1981 | Ward . | |
| 4,379,472 | 4/1983 | Cunningham . | |
| 4,410,026 | 10/1983 | Boggs . | |
| 4,573,980 | 3/1986 | Karrasch et al. . | |
| 4,845,038 | 7/1989 | Barr et al. | 215/384 X |
| 4,960,219 | 10/1990 | Jordan et al. | 215/354 |

FOREIGN PATENT DOCUMENTS

| | | | |
|---|---|---|---|
| 61777 | 5/1955 | France | 215/305 |
| 1121676 | 4/1956 | France | 215/305 |
| 1109915 | 3/1958 | France | 215/305 |
| 1166923 | 11/1958 | France | 215/305 |
| 2221354 | 10/1974 | France . | |
| 6046 | 1/1916 | United Kingdom . | |
| 882887 | 11/1961 | United Kingdom | 215/305 |

*Primary Examiner*—Gary E. Elkins
*Assistant Examiner*—Stephen Cronin
*Attorney, Agent, or Firm*—Amy L. H. Rockwell; Paul E. Schaafsma; Paul C. Flattery

[57] ABSTRACT

A closure for a tubular administration port is formed by inner and outer members having upper ends joined together in sealing relationship. The inner member has a sealed bottom end and is configured to fit within the administration port. The outer member is configured to engage about an exterior of the tubular port. The inner member includes radially outwardly extending ribs that engage against the interior of the administration port in an interference fit relationship.

25 Claims, 8 Drawing Sheets

PORT CLOSURE

BACKGROUND OF THE INVENTION

The present invention generally relates to closures for containers. More specifically, the invention relates to steam sterilizable closures or port protectors for medical containers.

In certain packaging arts, it is desirable to provide the user with a port through which he can access the contents of a package. For example, in the medical field, ports function as a means for allowing one to access the contents within the container so that they can be infused into a patient, compounded into a second package, or mixed with additional components. To this end, the ports provide a means for receiving a spike or other piercing means. An example of such a container with a port is the VIAFLEX® container, manufactured by Baxter Healthcare Corporation of Deerfield, Ill. U.S.A.

Especially in the medical field, it is necessary to maintain a portion of the port, specifically the area of the port that receives the spike or piercing means, in a sterile condition. Failure to maintain this internal portion of the port in a sterile condition can result in contamination of the contents of the container that could prove hazardous if the contents are infused into a patient. Accordingly, ports typically include a closure member that is designed to removably seal the port until the port is to be utilized.

Typically, the closure member includes a handle member, a sleeve member, and a guide member. The guide member is received within an internal channel defined by the port and the sleeve member circumstances at least a portion of the exterior of the port when the closure seals the port. A handle member is provided to allow the user to remove the closure from the port. To this end, the handle member is gripped by the user and pulled causing the closure to be removed from the port so that the port can be accessed.

A number of variations of closures and ports are known and used. An example of a port and closure is U.S. Pat. No. 4,573,980 that discloses a closure for a container having an elastic port protector for closing the end of a tubular port, for example, on a solution bag. The port protector defines an outer tubular section having inner and outer ends, and with an inner diameter which is less than the outer diameter of the tubular port on which it is intended to reside. An inner tubular section is connected to the outer tubular section at the outer end and is capable of occupying the bore of the outer tubular end in telescoping relation thereto. The inner tubular section has an outer diameter greater than the inner diameter of the tubular port, to fit into the bore of a tubular port in sealing relation. Handle means is carried on the outer tubular section to aid in removal of the port protector.

Closures for ports must meet a variety of requirements. They must provide protection to the port to maintain sterility. In this regard, they cannot fall off the port and must remain securely attached until removed by the user. They must provide a gripping surface on outer means for allowing the user to remove the port.

Closures or port protectors for steam sterilizable containers typically are difficult to design due to the effect of the extreme temperatures to which they are subjected during autoclave cycles. One solution to this problem has been to gamma-sterilize, i.e. pre-sterilize, a closure before autoclaving the container and closure assembly. This approach, however, is costly, and therefore not suitable for products the market for which is price sensitive.

SUMMARY OF THE INVENTION

The present invention provides an improved closure for a medical container. To this end, the invention provides a steam sterilizable administration port closure having a configuration that provides many advantages and is low in cost to manufacture, assemble, and sterilize.

In an embodiment, the invention provides a closure configured to close a tubular port, the closure including two members, the innermost of which is received within the port and which is sealed at its lower end to form a plug within the port. The members are sealed together at their upper ends. The inner members include radially outward directed ribs that provide an interference fit with an interior of the tubular port.

The closure is designed to be heat sterilized (autoclaved) with the medical container to which it is secured. As a result of the interference fit created by the ribs and the heat of sterilization during autoclaving, the ribs bite into the tubular port. This increases the force required to remove the closure from the port insuring the closure will remain on the port until intentionally removed by medical personnel.

In an embodiment, the closure includes a knurled extension which provides the user with means for gripping the closure to aid in removal thereof.

In an embodiment, the closure includes opposed wings which facilitate a "burping" of the closure upon assembly onto the administration port.

In an embodiment, the closure includes outwardly directed relatively shorter ribs extending from the inner tubular member and positioned at the top end thereof, the shorter ribs are operatively configured to prevent a closure of an interface between the inner and outer tubular members.

In an embodiment of the closure, the ribs extend vertically along the outer periphery of the inner tubular member to separate the plug from an internal side of the port and create a channel for moisture to enter the interface between the tubular members.

In an embodiment of the closure, the inner tubular member is configured with thin walls that collapse as a positive air pressure builds up in an air space captured between the inner and outer tubular members and port wall. This prevents a "back-off" of the closure, from the port, after assembly.

In an embodiment of the closure, the closure includes a rib that extends horizontally along an inner diameter of the outer tubular member. This horizontal rib creates an indentation in the tubular port during sterilization thereby to act as a sterile barrier.

In an embodiment, the plug is substantially hollow along its length.

In an embodiment, the plug is substantially solid along its length.

In an embodiment, the plug includes a cut-out portion at a lower end thereof.

A method of placing a closure on a port is also provided.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention provides a steam sterilizable closure for a tubular port. Preferably, the closure is for use on a container for housing medical fluid such as that disclosed in U.S. Pat. No. 4,573,980, the disclosure of which is hereby incorporated by reference. However, the closure can be used on other containers including ports on other access members.

Generally, the closure includes two concentric members operatively joined at upper ends thereof. The outer members engage an outer periphery of the tubular port. The inner member engages an inner periphery of the port and includes a bottom end closed to provide a plug within the tubular port. The outer periphery of the inner tubular member includes radially outwardly directed ribs that engage against an inner wall of the tubular port.

Figure 1:
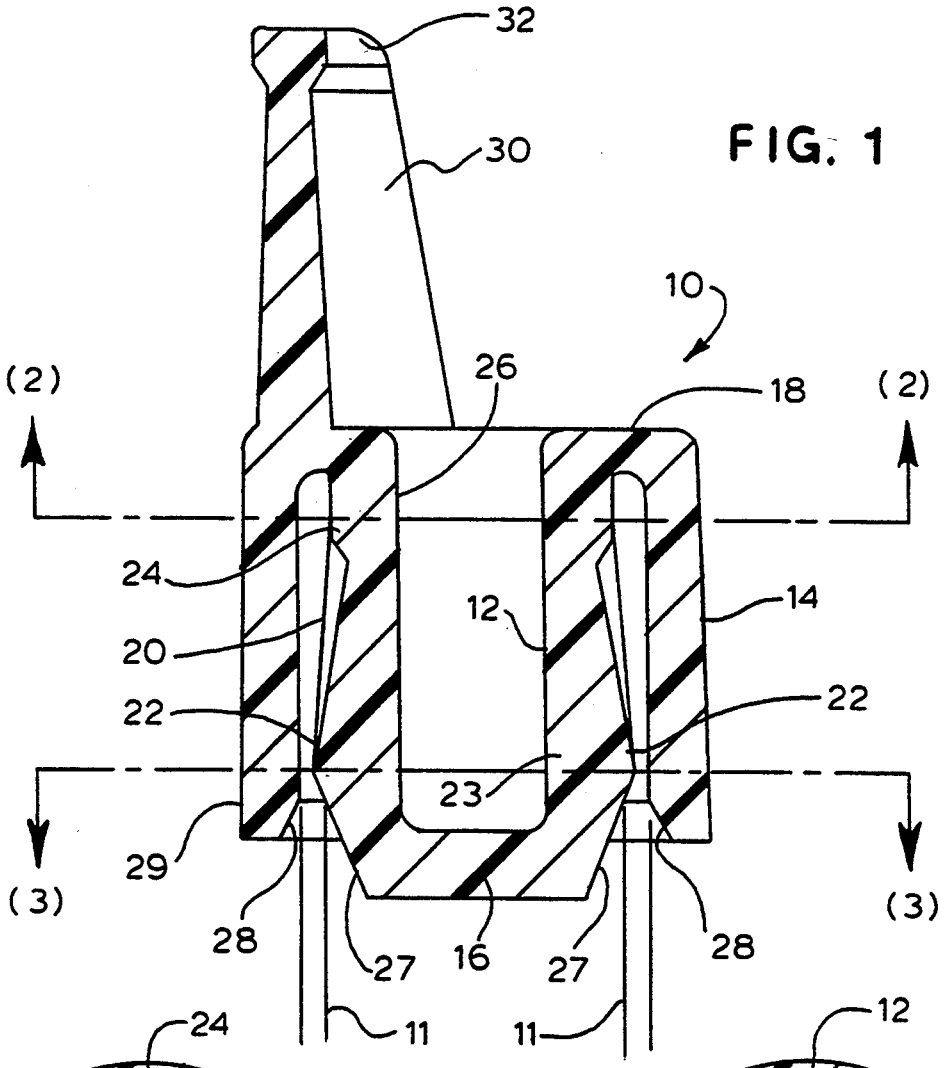
FIG. 1 illustrates in cross-sectional view an embodiment of the closure for a tubular port of the present invention.

Referring now to the figures, and specifically FIG. 1, there is illustrated a closure 10 for a tubular port 11 such as that described in U.S. Pat. No. 4,573,980. The closure 10 preferably is made of any elastomeric material. The closure 10 is used to maintain a sterile solution pathway in the port 11 and remains in place on a tubular port until use. To maintain the closure 10 on the port 11, an interference fit is created with the tubular port 11. Accordingly, the closure 10 does not require bonding to remain affixed to the port 11.

As illustrated, the closure 10 includes two concentric tubular members or tubes 12 and 14, the innermost tube 12 of which is sealed at its lower end 16, thereby forming a plug. The inner and outer tubes 12 and 14 are sealed at their upper ends 18 thereby to form a gap 20. The gap 20 captures a portion of the tubular administration port when the closure is placed on a port 11 as illustrated. This gap 20 also is referred to as the interface air space.

As further illustrated, the inner tube or plug 12 includes angled ribs 22 which extend radially outwardly therefrom at a lower end 23 thereof. The ribs 22 engage against an interior wall of the port 11 and form an interference fit with the inside diameter of the tubular port 11, which is positioned between the inner tube 12 and the outer tube 14. The interference fit prevents or impedes a "back-off" of the closure 10 from the tubular port 11.

To this end, as a result of the interference fit and heat of sterilization, the ribs 22 bite into the tubular port 11 and increase the required pull-off force. The ribs 22 also, by maintaining the gap 20 between the inner and outer tubes 12 and 14, allow heat and steam to penetrate the closure/port interface thus enhancing sterilization efficiency.

In addition to the large angled ribs 22, relatively shorter ribs 24 can be positioned at an upper end 26 of the inner tubular member 12 to also provide an aid to sterilization by keeping the interface open at the upper ends of the tubes 12 and 14. These short ribs 24 also extend radially outwardly from the inner tubular member 12 and can prevent the top of the tubular port 11 from deforming during steam sterilization and potentially compromising the sterile barrier.

Figure 2:
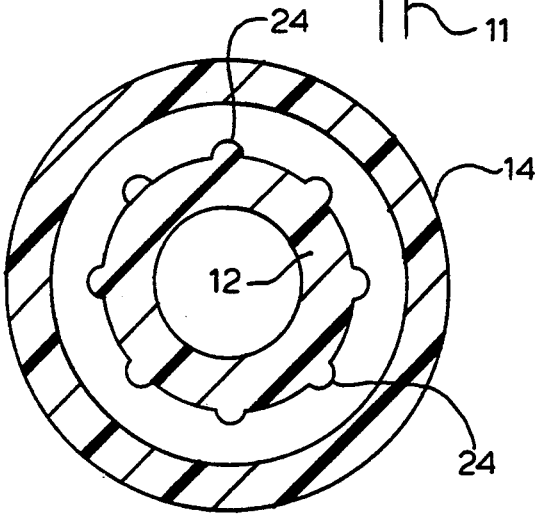
FIG. 2 illustrates a sectional view of the closure of FIG. 1 taken along lines II—II of FIG. 1.
Figure 3:
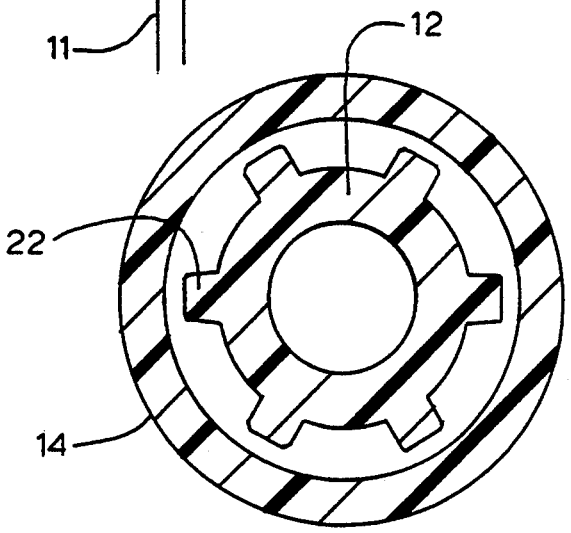
FIG. 3 illustrates a sectional view of the closure of FIG. 1 taken along lines III—III of FIG. 1.

As illustrated in FIG. 2, the relatively shorter ribs 24 preferably are rounded in transverse sectional view. In contrast thereto, as illustrated in FIG. 3, the relatively larger ribs are preferably rectangular in transverse sectional view.

By having a tubular design, the inner tube 12 maintains the membrane tube, of the port, opening diameter to allow for easier spiking. Further, in addition to its functional performance, the inner tubular member 12 can be specifically designed to interface with automated assembly equipment. An indentation or recess 28 in the center of the inner tubular member 12 and chamfers 27 and 28 at the base or lower ends 16 and 29 of the inner tubular member 12 and outer tubular member 14, respectively, are designed to aid automated assembly.

The closure 10 may be fitted into the port 11 during assembly with relative ease using a probe member which extends into the interior of the inner tubular member 12 and engages against the closed end 16 to stretch the inner tubular member 12 and drive it into the port 11. As the inner tubular member 12 is stretched, its diameter sufficiently decreases, which further facilitates insertion.

An outer skirt of the closure 10 defined by the outer tube 14 can be specifically dimensioned to form an interference fit with the tubular port 11 thus creating a sterile barrier. The very bottom of the skirt 14 also can be chamfered to provide improved automated assembly efficiency. The interference fit of the outer skirt 14 with the tubular port 11 also serves to increase the force needed to remove the closure 10 from the port 11.

Preferably, the closure 10 is provided with a tab 30 with a specially knurled end 32 which allows a user to grip the closure 10 with wet hands or while wearing surgical gloves. This is a function of and accomplished by the ratio of handle thickness to handle knurl thickness. A larger knurl thickness provided a greater edge for grasping.

The construction of the closure 10 also aids in manufacturing the closures. The outer geometry of the closure 10 increases the number of cavities which can be placed in a mold. Specifically, the tab 30 protruding outwardly from the top of the closure 10 serves to significantly increase mold cavitation.

Figure 4:
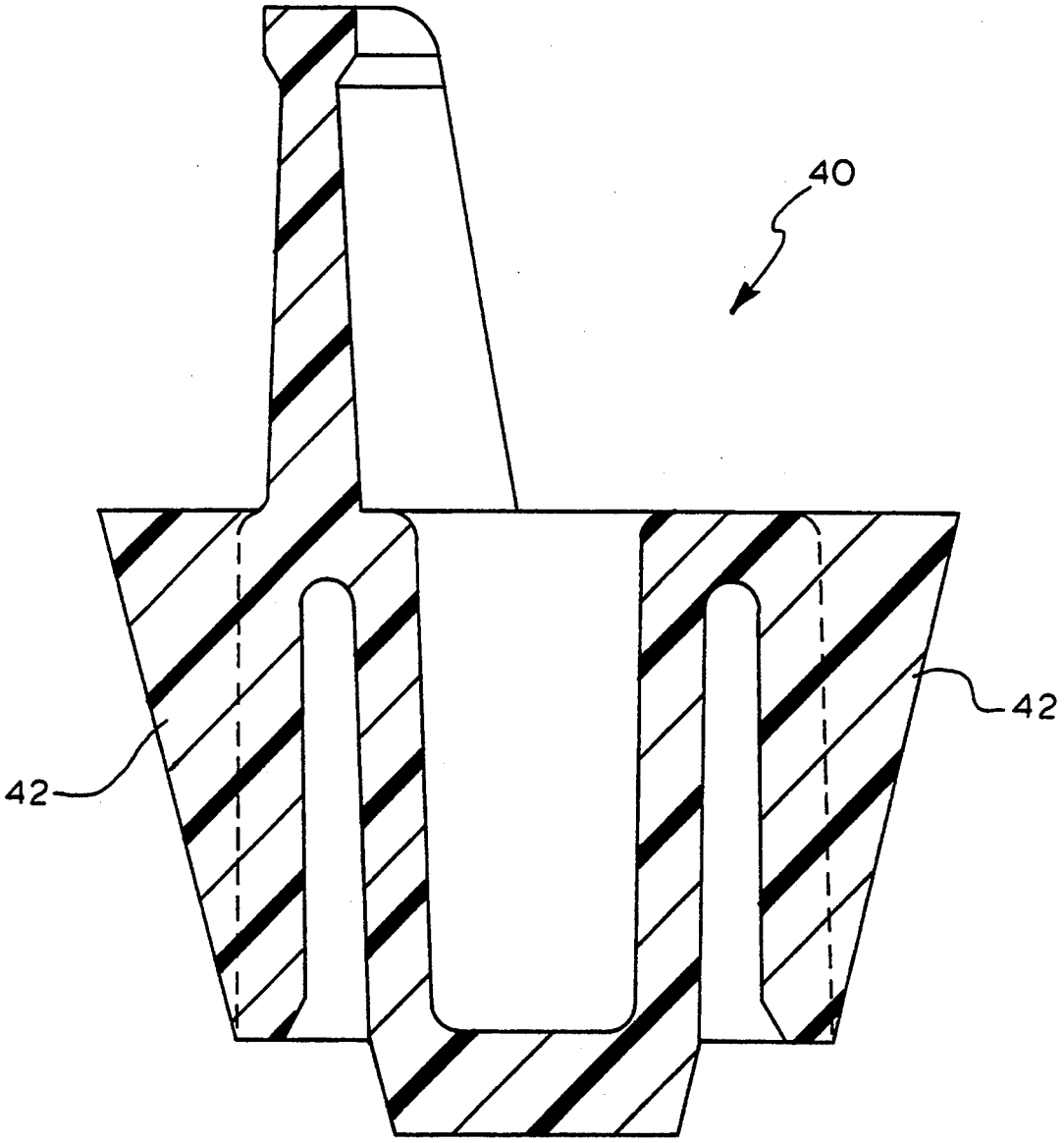
FIG. 4 illustrates in cross-sectional view another embodiment of the closure of the present invention.

FIG. 4 illustrates another embodiment of the closure 40. The embodiment of the closure 40 illustrated is similar to the closure 10. However, the closure 40 includes integral opposed wings 42. The wings 42 facilitate "burping" of the closure upon assembly onto the tubular port 11.

Air trapped in the port when the closures are placed thereon can cause a "back-off" of the closure from the port. The wings 42 in conjunction with machinery for pinching the wings 42 can prevent back-off.

Figure 5:
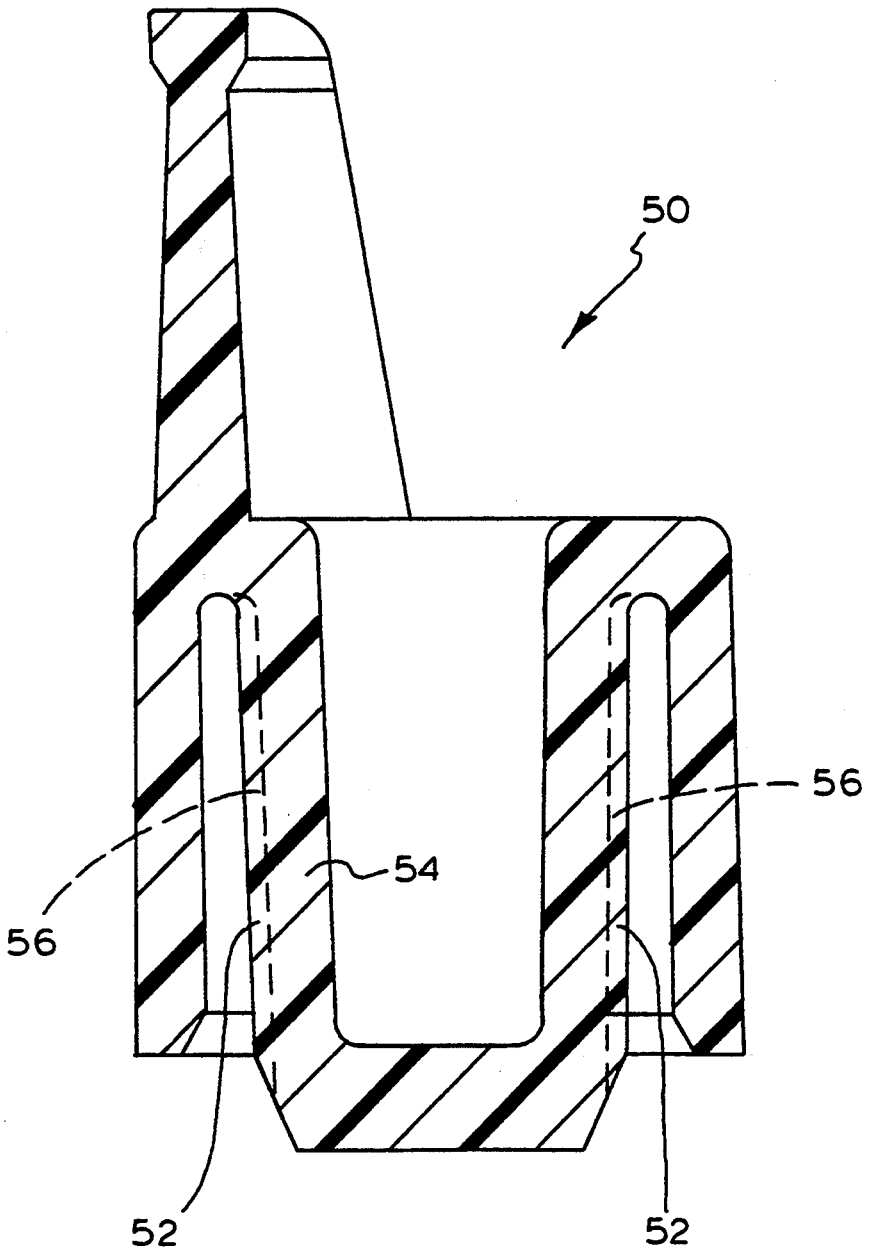
FIG. 5 illustrates in cross-sectional view another embodiment of the closure of the present invention.

FIG. 5 illustrates an embodiment of the closure 50 including vertical ribs 52 which extend along the entire length of the inner tubular member 54. In this configuration, the ability of moisture to enter into the closure/-tubular port interface is improved. The vertical ribs 52 are configured to separate the inner tubular member 54 from the internal side of the tubular port and create a channel 56 for the moisture to enter the closure/port interface.

Figure 6:
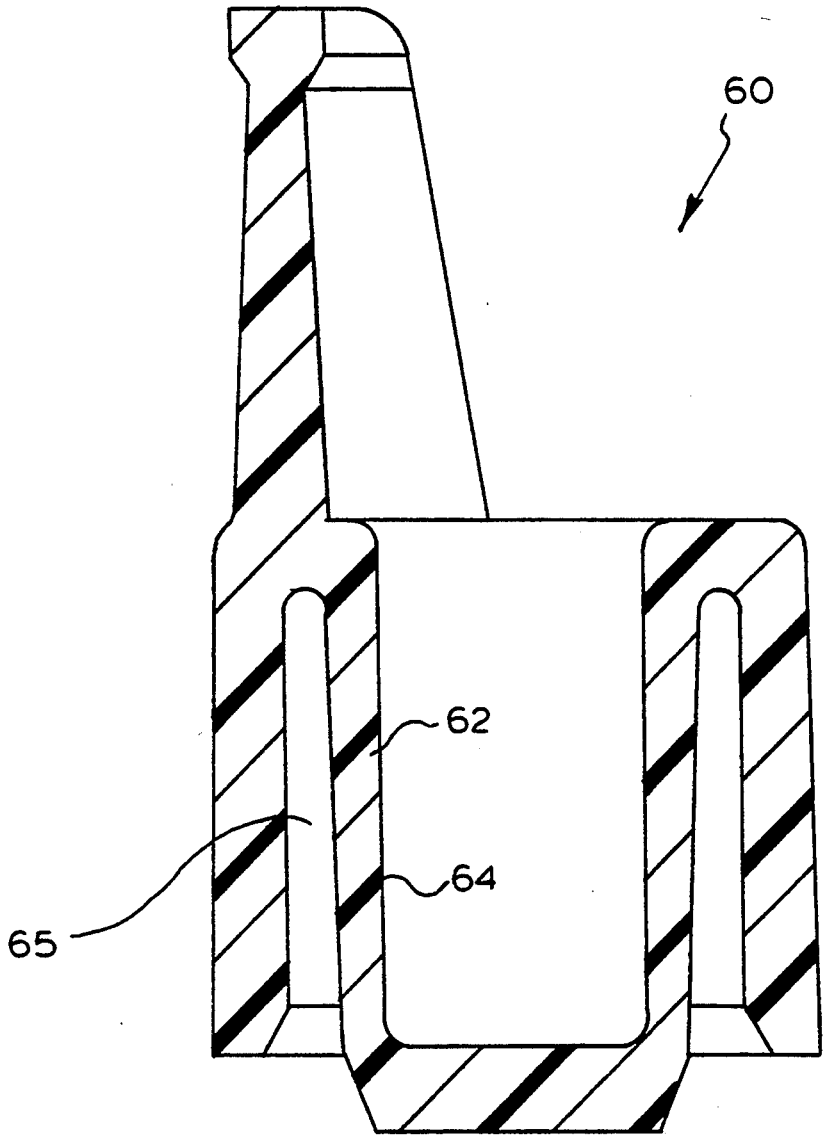
FIG. 6 illustrates in cross-sectional view another embodiment of the closure for a tubular port of the present invention.

FIG. 6 illustrates a further embodiment of the closure 60 which includes an inner tubular member 62 with a relatively thin wall 64. Due to the use of the thin wall 64, the inner tubular member 62 collapses as pressure builds up in the interface air space 65. This also prevents back-off of the closure 60 after assembly onto the tubular port.

Moreover, this configuration illustrated in FIG. 6 increases the effort required to replace the closure 60 on the tubular port after it has been removed. Thus, a tamper-evident closure 60 is provided.

Figure 7:
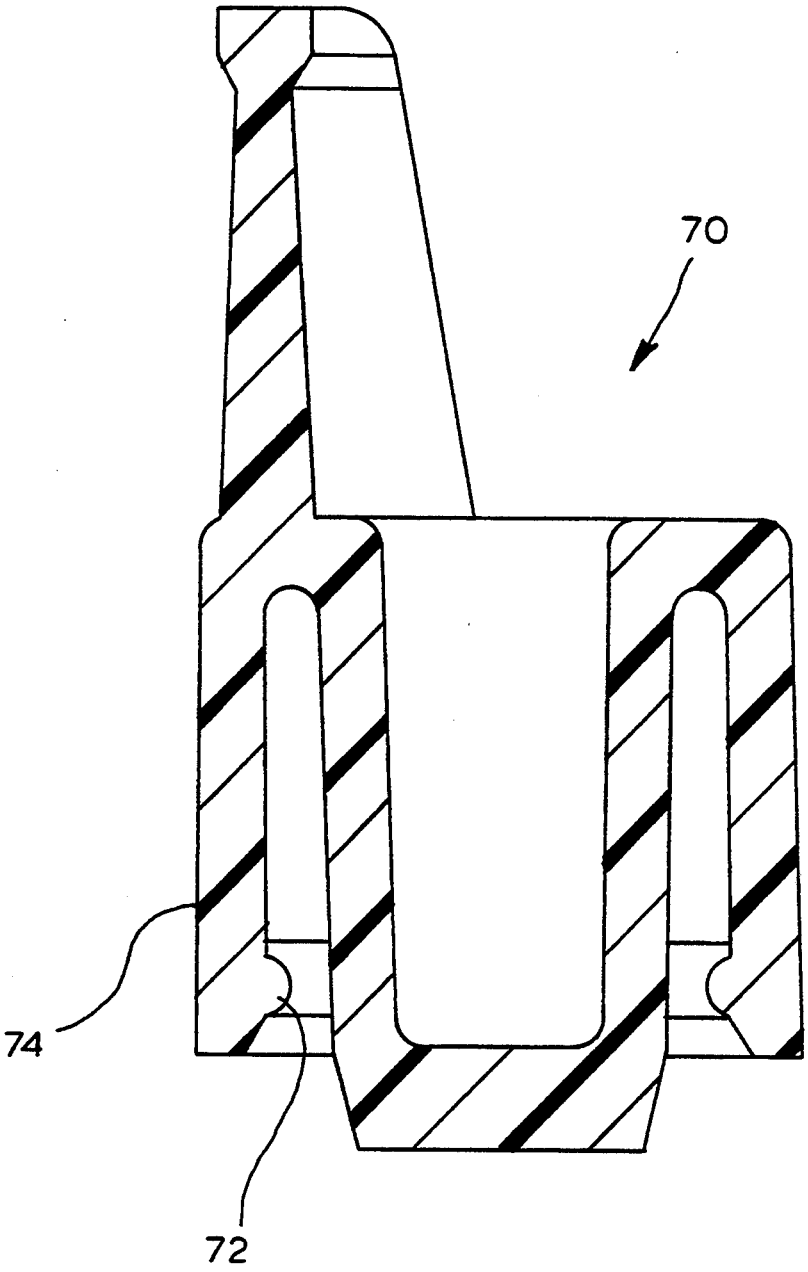
FIG. 7 illustrates in cross-sectional view another embodiment of the closure for a tubular port of the present invention.

FIG. 7 illustrates another closure 70 in which an annular horizontal rib 72 is provided on the inside diameter of the outer tubular member or skirt 74. This annular rib 72, which runs horizontally along the inside diameter of the outer tubular member 74, creates an indentation in the tubular port during sterilization. The annular rib 72 thereby bites into the tubular port. This acts as a sterile barrier as well as increases the removal forces required to remove the closure 70 from the tubular port.

Figure 8:
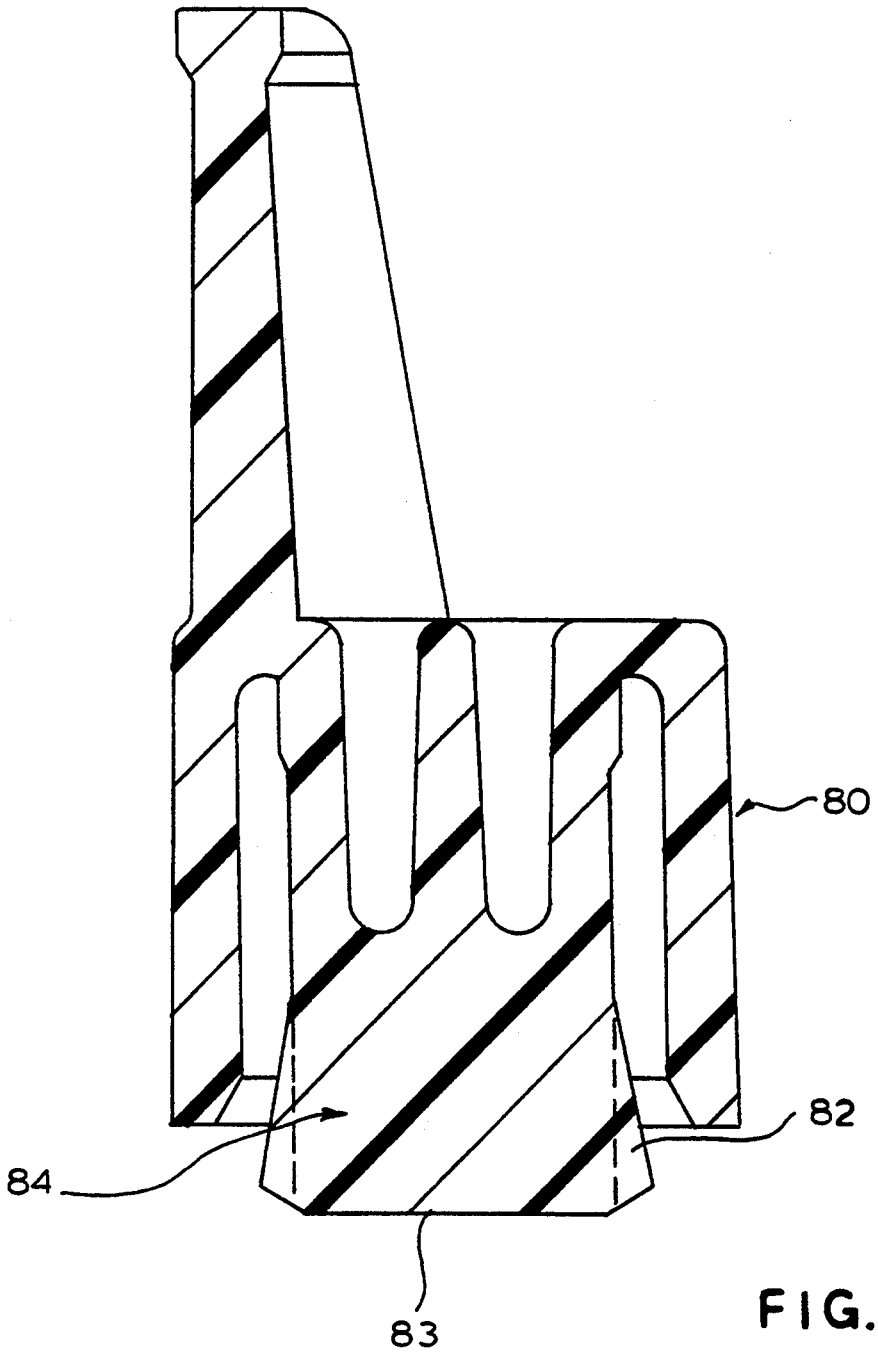
FIG. 8 illustrates in cross-sectional view another embodiment of the closure for a tubular port of the present invention.

FIG. 8 illustrates another embodiment of the closure 80. The closure 80 includes angled ribs 82 which extend outwardly at a lower end 83 of the plug 84. In comparison to the closure of FIG. 1, the plug 84 of FIG. 8 includes more solid area.

Figure 9:
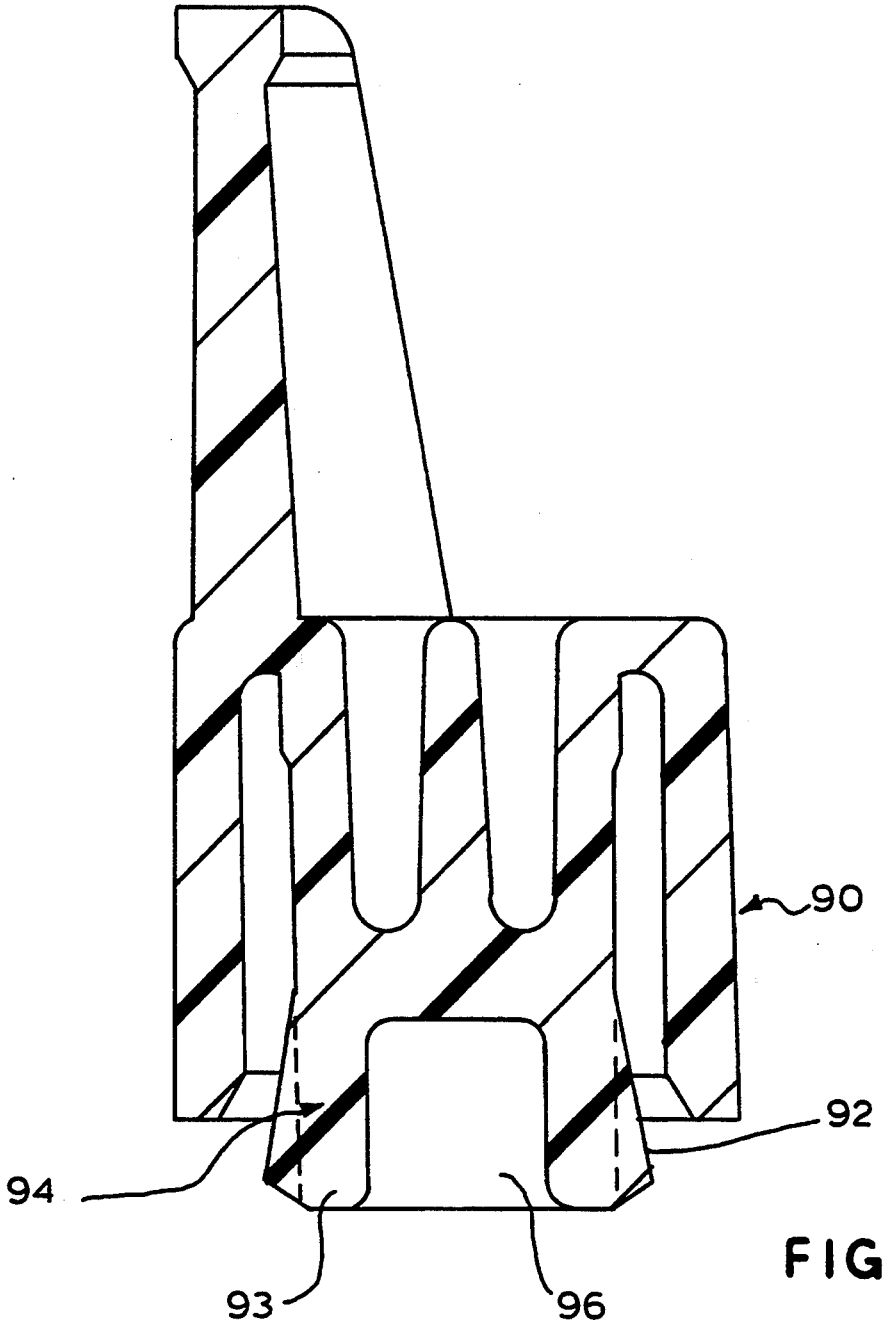
FIG. 9 illustrates in cross-sectional view another embodiment of the closure for a tubular port of the present invention.

FIG. 9 illustrates another embodiment of the closure 90. This embodiment is similar to the embodiment of FIG. 8 in that it includes angled ribs 92 at a lower end 93 of the plug 94. However, the plug 94 also includes a cut-out portion 96 at a bottom thereof.

Figure 10:
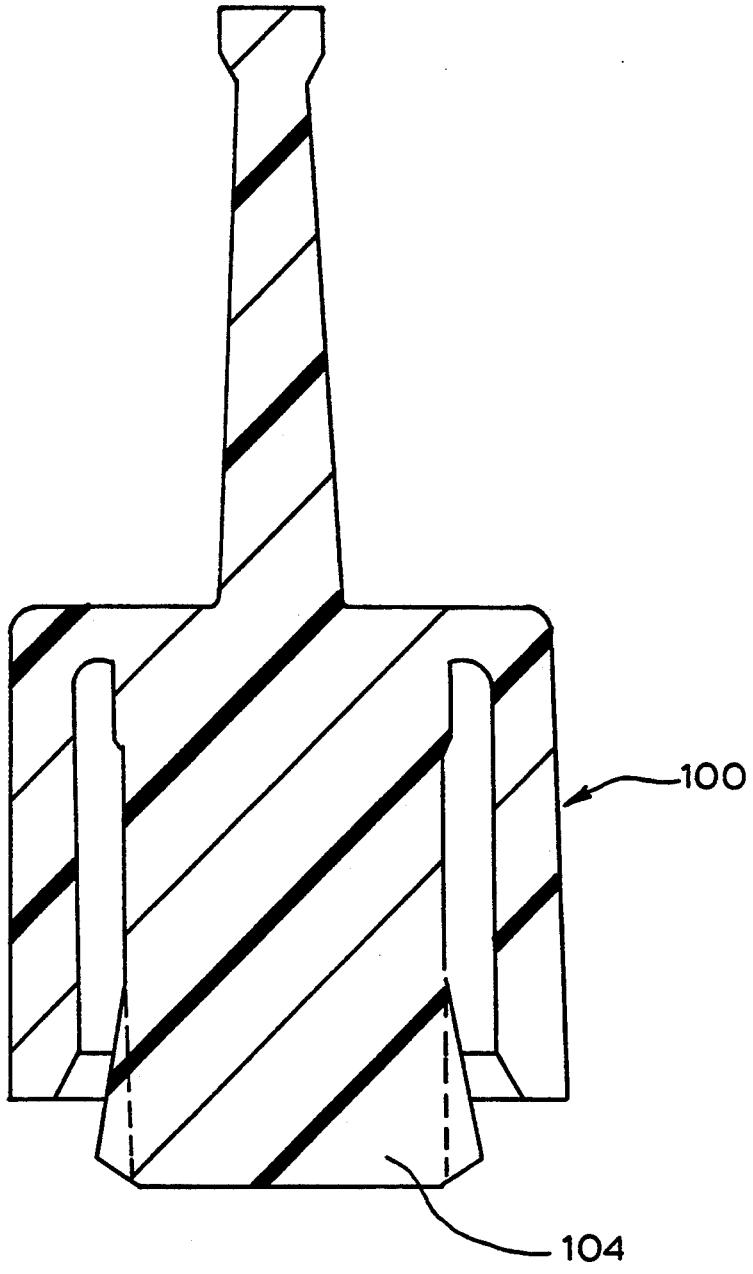
FIG. 10 illustrates in cross-sectional view another embodiment of the closure for a tubular port of the present invention.

FIG. 10 illustrates a still further embodiment of the closure 100. This embodiment of the closure 100 is similar in some aspects to the embodiment illustrated in FIG. 8. But in the embodiment of closure 100 the plug 104 is substantially solid.

Each of these closures 10, 30, 40, 50, 60, 70, 80, 90 and 100 preferably is integrally formed in a mold and made of a suitable sterilizable elastomeric material.

The geometries of the foregoing closures 10, 30, 40, 50, 60, and 70 provide for round target areas which enhance spikability of the closures. Because deformation of the tubular port coincides with the dimensions of these closures, the variability of removal forces of the closures is reduced allowing for ease of removal of the closures. This is an improvement over existing closures. The increased removal forces attributed to the angled ribs on the respective inner tubular members, prevents accidental fall off of the closures prior to use.

The construction of the closures 10, 30, 40, 50, 60, 70, 80, 90 and 100 provides a distinctive "pop" sound upon removal of the closures. This is due, at least in part, to the geometry of the inner tubular members and the seal of the outer tubular member about the tubular port. The pop sound indicates to a user that a secure fit between the closure and the tubular port was present and that the closure is acceptable for use.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

What is claimed is:

1. A closure for a tubular administration port, the closure comprising:

inner and outer concentrically disposed tubular members, the inner and outer members being joined at an upper end thereof, the inner tubular member having a sealed lower end extending a greater length than the outer tubular member and forming a plug that is so constructed and arranged to be received within an interior of a port, the outer tubular member configured to fit about an exterior of the tubular port in an interference fit relationship, the inner tubular member including radially outwardly extending ribs that are peripherally spaced and engage against the interior of the tubular port providing an interference fit against the interior of the administration port.

2. The closure of claim 1 further including a knurled tab extending axially from the upper end of the tubular members.

3. The closure of claim 1 wherein the closure is made of a steam sterilizable elastomeric material.

4. The closure of claim 1 wherein the outer tubular member includes radially outwardly extending wings capable of being urged toward each other to cause air to vent out of a port upon which the closure is positioned.

5. The closure of claim 1 wherein the inner tubular member includes a second set of ribs that provide a further interference fit against the interior of the administration port.

6. The closure of claim 1 wherein the inner tubular member has a thin wall capable of collapsing as a positive air pressure builds up in an air space defined between the inner and outer tubular members.

7. The closure of claim 1 wherein the ribs extend along an axial length of the inner tubular member.

8. The closure of claim 1 wherein the outer tubular member includes a circumferential inwardly extending rib configured to form a sterile barrier about an outer circumference of a port upon which the closure is located.

9. The closure of claim 1 wherein the plug is substantially solid throughout its length.

10. The closure of claim 1 wherein the plug is substantially hollow throughout its length.

11. The closure of claim 1 wherein the plug includes a cut-out portion at a bottom thereof.

12. A stream sterilizable elastomeric closure for sealing a tubular administration port, the closure comprising:

a body having at a first end a gripping surface and at a second end a sleeve for circumscribing an outer surface of the port when the closure seals the port, the body defining a plug configured to fit within an interior of the port, the plug including radially outwardly extending ribs that are peripherally spaced and engage against the interior of the tubular port to provide an interference fit against the interior of the administration port, the plug extending a distance greater than the sleeve of the second end.

13. The closure of claim 12 wherein the sleeve includes radially outwardly extending wings.

14. The closure of claim 12 wherein the plug has thin walls that are capable of collapsing as a positive air pressure builds up in an air space between the plug and sleeve.

15. The closure of claim 12 wherein the ribs extend along an axial length of the plug.

16. The closure of claim 12 wherein the sleeve includes a circumferential inwardly extending rib configured to form a sterile barrier about an outer circumference of the administration port.

17. The closure of claim 12 wherein the plug is substantially solid throughout its length.

18. The closure of claim 12 wherein the plug is substantially hollow throughout its length.

19. The closure of claim 12 wherein the plug includes a cut-out portion at a lower end thereof.

20. A closure for a tubular administration port, comprising:

inner and outer concentrically disposed tubular members operatively joined in sealing relationship at upper ends thereof, the inner tubular member having a sealed lower end thereby to provide a plug configured to fit within an interior of the administration port, the outer tubular member configured to fit about an exterior of the tubular port in an interference fit relationship, the inner tubular member including two sets of radially outwardly extending ribs that engage against the interior of the tubular port thereby to provide an interference fit against the interior of the administration port, the first set of ribs extending from a lower portion of the tubular member, the second set of ribs being relatively shorter than the first set and extending from an upper portion of the inner tubular member.

21. The closure of claim 20 wherein the closure is made of a steamed sterilizable elastomeric material.

22. The closure of claim 20 wherein the outer tubular member includes opposing radially outwardly extending wings capable for allowing a port to which the closure is attached to be vented.

23. The closure of claim 20 wherein the inner tubular member has relatively thin walls capable of collapsing as positive pressure builds up in an air space between the inner and outer tubular members.

24. The closure of claim 20 wherein the outer tubular member includes a circumferential inwardly extending rib configured to form a sterile barrier about an outer circumference of the administration port.

25. A stream sterilizable elastomeric closure for sealing a tubular administration port comprising:

a body having at a first end a gripping surface and at a second end a sleeve for circumscribing an outer surface of the port when the closure seals the port, the body defining a plug configured to fit within an interior of the port, the plug including radially outwardly extending ribs that engage against the interior of the tubular port to provide an interference fit against the interior of the administration port, wherein the plug includes two separate sets of ribs extending radially outwardly and providing an interference fit against the interior of the administration port.

* * * * *